US005451367A

United States Patent [19]

Stark et al.

[11] Patent Number: 5,451,367

[45] Date of Patent: Sep. 19, 1995

[54] METHOD OF STERILIZING THE INSIDE LAYER IN A PACKAGING MATERIAL

[75] Inventors: Olof Stark, Ystad; Hakan Möller, Malmö, both of Sweden

[73] Assignee: Tetra Laval Holdings & Finance S.A., Switzerland

[21] Appl. No.: 128,199

[22] Filed: Sep. 29, 1993

[30] Foreign Application Priority Data

Oct. 7, 1992 [SE] Sweden ..... 9202933

[51] Int. Cl.[6] ..... A61L 2/08; B65D 85/72; B32B 27/00; B32B 55/08

[52] U.S. Cl. ..... 422/22; 426/107; 426/248; 428/36.5; 428/319.7; 53/167

[58] Field of Search ..... 426/107, 234, 248, 392, 426/398, 407, 412; 428/319.3, 319.7, 36.5, 318.4, 318.6; 422/22; 53/167

[56] References Cited

U.S. PATENT DOCUMENTS

| | | | |
|---|---|---|---|
| 3,941,643 | 3/1976 | Balla | 156/380 |
| 3,994,686 | 11/1976 | Rauser et al. | 426/248 X |
| 4,305,000 | 12/1981 | Cheever | 250/492.3 |
| 4,367,412 | 1/1983 | Cheever | 250/492.3 |
| 4,464,336 | 8/1984 | Hiramoto | 422/22 X |
| 4,507,338 | 3/1985 | Freundlich | 428/36.5 |
| 4,785,937 | 11/1988 | Tamezawa et al. | 426/415 X |
| 4,985,300 | 1/1991 | Huang | 426/392 X |
| 5,034,235 | 7/1991 | Dunn et al. | 426/248 X |
| 5,122,410 | 6/1992 | Lofgren et al. | 428/216 |
| 5,180,894 | 1/1993 | Quick et al. | 426/107 X |
| 5,326,542 | 7/1994 | Sizer et al. | 422/291 |

FOREIGN PATENT DOCUMENTS

| | | | |
|---|---|---|---|
| 2236278 | 4/1991 | United Kingdom | 426/107 |

*Primary Examiner*—Robert J. Warden
*Assistant Examiner*—E. Leigh Dawson
*Attorney, Agent, or Firm*—Burns, Doane, Swecker & Mathis

[57] ABSTRACT

The invention relates to a method for the sterilization of the inside layer of a packaging material, the packaging material being produced as a laminate with an inside layer of a transparent thermoplastic which is applied on a reflective material layer. The sterilizing energy includes high energy light flashes emitted from one or more flash units, the light flashes being caused to act on the inside of the packaging material for purposes of exterminating bacteria and microorganisms present on the surface. Because the light flashes emitted from the flash unit are reflected by the reflective layer, the surface layer of the layer will be influenced by both the direct and the reflecting photoenergy from the flash units, the sterilizing effect being thereby improved. Packaging material well-suited for sterilization according to the method is also disclosed.

20 Claims, 1 Drawing Sheet

METHOD OF STERILIZING THE INSIDE LAYER IN A PACKAGING MATERIAL

TECHNICAL FIELD

The present invention relates to a method of sterilizing the inside layer of a packaging material intended for packing sterilized or bacteria-reduced foods.

BACKGROUND AND SUMMARY OF THE INVENTION

Such a method is, for example, previously known from U.S. Pat. No. 4,464,336. However, it has proved that sterilization using flash light is not wholly effective in packaging materials with a high bacteria coating or contamination, probably because certain surface layers which contain bacteria or microorganism colonies are "shadowed" by superjacent bacteria colonies. As a result of this shadowing effect, not all bacteria or microorganisms located on the packaging material surface are reached during the treatment process. By producing, in the manner disclosed in the appended Claims, a packaging material with a transparent plastic inside and a subsequent light-reflective coating, it is possible to re-reflect substantial proportions of the emitted light which will then impinge upon the packaging material surface from "the opposite direction" as compared with direct light treatment and, thereby, to affect even those bacteria most proximal the surface layer which are not exposed to the direct effects of the light from the flash bulb. Naturally, this secondary light effect will not be as strong as the direct light effect, since the light will, first, be obliged to travel a longer distance, secondly pass through the transparent plastic surface layer twice, and thirdly be reflected by the light-reflective layer. However, by employing a plastic layer which is as transparent as possible, and by utilizing as good a light-reflective capacity as possible in the reflective layer, it is possible at those photoenergy levels which are employed, to obtain a reflected light wave which has a photoenergy of up to 90 percent of the initial energy.

BRIEF DESCRIPTION OF THE DRAWING

The present invention will now be described in greater detail hereinbelow, with particular reference to the accompanying drawing, in which.

DESCRIPTION OF PREFERRED EMBODIMENT

Figure 1:
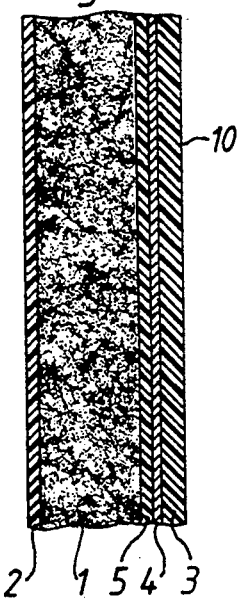
FIG. 1 is a cross-sectional view of packaging material according to an embodiment of the present invention.

The packaging material illustrated in FIG. 1, which may be manufactured in the form of a web, consists of a core layer 1 of, for instance, paper or cardboard, but the core layer may also includes, for example, foamed plastic (expanded polystyrene or polypropylene). This core layer 1 is, at least if the core layer includes fibrous material, preferably, provided with an outside coating 2 of a thermoplastic, for example polyethylene, and the inside 3 of the laminate preferably includes a thermoplastic with slight light absorption, i.e., of high transparency, and a surface 10 of substantial surface smoothness, e.g., polyethylene or polypropylene. Between the inside layer 3 and the core layer 1, there is provided a light-reflective layer 4 which preferably is laminated to the core layer I with the aid of a binder or adhesive layer 5. For the purposes of the present invention, it is the inside layer 3 and the light-reflective layer 4 that are of importance and these will, therefore, be discussed separately.

As has been mentioned above, the inside layer 3 is preferably of high transparency so as not to absorb light which passes through the layer, and the layer, moreover, is preferably of extremely good surface smoothness, partly to reduce the bacteria coating and partly to permit light penetration without diffuse reflection or extremely high surface absorption. A material possessing high surface smoothness may be obtained by stretching extruded plastic film, for example polypropylene film, in which event the plastic film 3 is produced separately and is laminated to the light-reflective layer 4 by means of a thin transparent adhesive or binder, e.g., molten polyethylene.

The light-reflective layer 4 preferably includes a metal foil, e.g., aluminium foil, whose bright-rolled surface is turned to face towards the inside layer 3 for the purposes of obtaining a high degree of light reflection from the layer 4. It is also possible to employ, instead of a metal foil such as aluminium foil, a metallized film, such as a thin polyester film which has been metallized by vacuum deposition of aluminium material on the polyester foil layer or direct on the inside layer 3. A metallized polyester film 4 can be laminated to the core layer 1 and the inside layer 3 in the normal manner by extrusion of an adhesive or binder, e.g., polyethylene. If the inside layer 3 is prefabricated and stretched for obtaining a smooth surface 10, it is also possible to apply a metallization in the form of a vacuum deposited aluminium layer direct on the film 3, and this vacuum deposited layer will, in such an event, form the layer which is designated 4 in FIG. 1. In the production of the laminate which is to constitute the packaging material, is preferable to provide an inside layer 3 of plastic material possesses as slight light absorption properties as possible and it is further preferable to provide a light-reflective layer 4 possessing the best possible reflective capability. The inside layer 3 is preferably, in addition, heat-sealable so that tight packages with mechanically durable seams or joints can be manufactured from the material.

Those packages which are manufactured from the disclosed packaging material are preferably of the type which begin as a planar web which is formed into a tube. The edges of the web are the preferably united with one another, and afterwards the intended contents of the package are supplied to the interior of the tube. By repeated flat pressings of transverse seals at right angles to the longitudinal axis of the tube, the tube is divided into package units which are separated from the tube and are formed by folding into a package of the contemplated shape. In cases where the contents intended for the package consist of, for example, a sterilized food, the inside of the packaging material must also be sterilized since otherwise the sterilized food would be re-infected on coming into contact with the inside of the packaging material.

Figure 3:
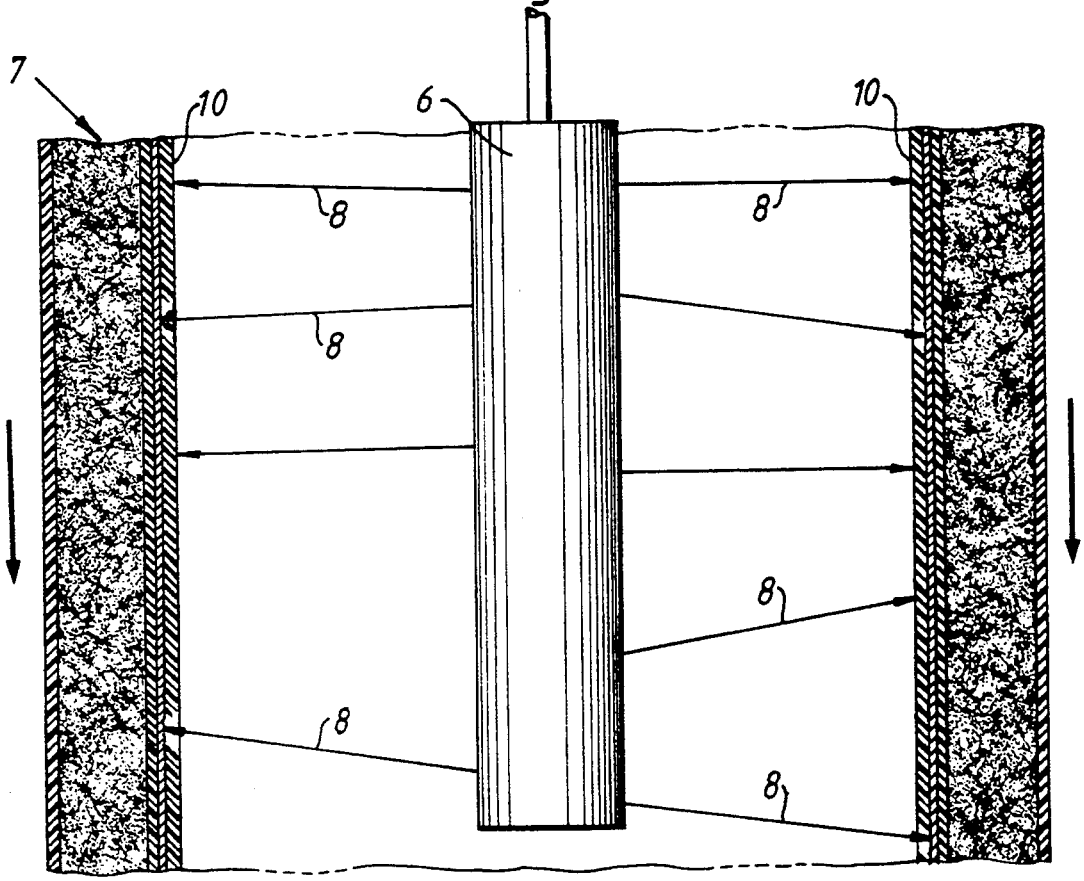
FIG. 3 is a cross-sectional view of a packaging tube according to an embodiment of the present invention including a flash unit according to the invention disposed within the tube.

In the case described here, sterilization of the inside 10 of the packaging material takes place in such a manner that the packaging material is formed into a tube 7 by the longitudinal edge zones of the material being united with one another in a tight and durable seam or joint. This is effected in that mutually applied plastic layers are caused, within the seam or joint zone, to melt and fuse together under the supply of heat and pressure and thereafter are stabilized by cooling. Such a tube 7 may be formed continuously by a progressive unreeling of a planar material web from a magazine reel in that the web is gradually folded into tube form in order for its edge zones to be united and sealed to one another. For sterilizing the inside of the tube 7, the tube is preferably disposed, as illustrated in FIG. 3, concentrically around a flash discharge unit 6 whose longitudinal extent runs in the axial direction of the tube 7. In this embodiment, the flash discharge unit 6 is shown as a cylindrical lamp, but it may also consist of a plurality of lamps or flash tubes disposed beside one another or in mutual sequence of per se known type. The light emitting flash unit 6 is positionally fixed, while, on the other hand, the tube 7 is disposed to move in relation to the flash unit 6 in the direction of the arrow shown in FIG. 3. The flash unit 6 is connected to a supply unit which feeds pulses to control the flash emission of the flash unit at a frequency of between 1 and 10 pulses per second, preferably between 2 and 6 pulses per second, with a pulse duration of between 20 and 2000 μs. The pulse length, like the pulse frequency, may be varied considerably depending upon the design of the installation and the treated object, and the values disclosed above are merely to be considered as typical value ranges. The light dose which impinges on the inside layer of the packaging material may be regulated by the voltage supplied to the flash unit tube 6 and, to achieve a satisfactory bacteria-destructive affect, should amount to between 2 and 10 Joules per $cm^2$. The tube 7 preferably moves in relation to the flash unit 6 at relatively low speed and accordingly, the same region will be illuminated and affected a plurality of times depending upon the frequency of flashes emitted. In addition to the relative speed of the tube 7 in relation to the flash unit 6 and the frequency of emitted light flashes, the length and flash intensity of the flash unit 6 also influence the level of final effect. Thus, if the tube 7 moves more quickly in relation to the flash unit 6, it is possible to achieve a sufficient bacteria-destructive effect by either increasing the length of the flash unit 6, increasing the frequency of the emitted flashes or their intensity, in addition to increasing the number of flash unit lamps proper.

Figure 2:
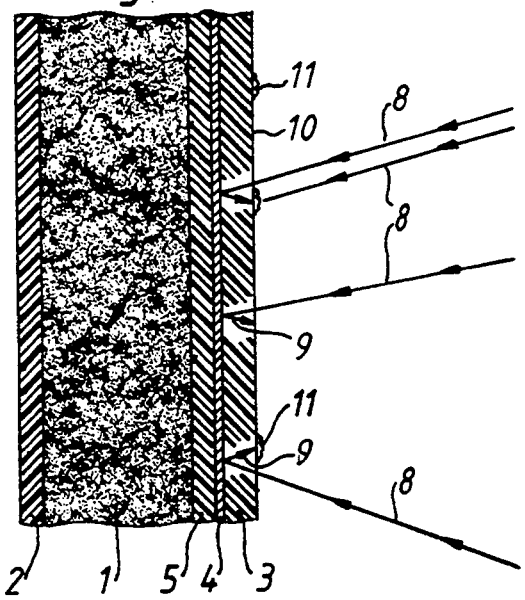
FIG. 2 is a cross-sectional view of packaging material according to an embodiment of the present invention showing reflection of light flashes according to the invention.

As is apparent from FIG. 2, the surface 10 of the inside layer 3 is influenced partly by direct light flashes which are represented by the lines 8, and partly by indirect light flashes or reflected light flashes, which are represnted by the lines 9. This implies that colonies of bacteria and microorganisms 11 located on the surface 10 of the inside plastic layer 3 will be affected all-round by the emitted light flashes and an improved bacteria destruction result will be achieved.

As a result of the energy emissions, the inside layer 10 of the tube will be heated to some degree—but not to such an extent that this thermal effect alone could entail any sterilization. That which has been mentioned above in respect of the application of the present invention in the forming of packages starting from a tube 7 is only intended to illustrate a particularly advantageous field of application. Thus, it is possible in accordance with the inventive concept, to apply the method not only to raised package blanks or containers which are interiorly sterilized by means of flash discharge units 6 inserted into the blanks, but also to planar webs or sheets of packaging material which are formed into packages by means other than conversion into a tube. As has been mentioned in this description, the light reflecting layer 4 may either include a bright rolled metal foil, preferably aluminium foil, or of a so-called metallized surface, which is normally obtained by vacuum deposition of vaporized metal, for example aluminium, on a smooth film, for example plastic film. Such a vacuum deposited surface is preferably extremely thin, since the surface layer is only a few molecules thick, but it can nevertheless provide an extremely good light reflection if the surface on which the metal is deposited is of sufficient surface smoothness. Glass or glass-like silicons may also, in a similar manner, be vacuum deposited onto a substrate and such a vacuum deposited glass layer affords a good gas barrier, as opposed to a vacuum deposited metal layer. Consequently, it is possible according to the present invention to produce a packaging material possessing a good gas barrier which is also environmentally safe, since it consists in principle of but a single material. Such a material may include a core layer of "foamed" or expanded polypropylene which is laminated together with a transparent polypropylene film presenting a light-reflective layer of vacuum deposited metal (aluminium), and a layer of gas-tight vacuum deposited glass. The vacuum deposited layers can either be laid one outside the other or be incorporated into the laminate as one coating on a special laminate film. The films included in the laminate can be co-laminated together by means of extruded polypropylene in a per se known manner. An advantage of the described laminate (apart from giving an effective sterile treatment with flash light), is that the material may be nearly 100 percent of a single plastic material, polypropylene in the present case. This implies major advantages when the material is to be recycled for reuse, since it can quite simply be melted down in its entirety. Granted, the material does contain a vacuum deposited metal layer and, if it is rendered gas-tight, a vacuum deposited glass layer, but as was mentioned earlier, these layers are preferably extremely thin (only a few Ångström), so that they do not contaminate in any decisive manner the molten plastic material on recycling by melting. It has proved that sterilization treatment using flash illumination is extremely effective and, moreover, gives no side effects in the form of residual products, as is often the case in chemical sterilization. By applying the method according to the present invention, it is possible to give sterilization treatment to packaging material which has a high bacterial loading.

The present invention should not be considered as restricted to that described above and shown on the drawing, many modifications being conceivable without departing from the spirit and scope of the appended claims.

In the embodiments of the invention described above the reflecting layer 4 is a metal layer or a vacuum deposited layer. It is, however, possible to obtain a good reflection even with a white paper layer as a reflecting surface.

What is claimed is:

1. A packaging material adapted to be sterilized by photoenergy supplied from a radiation source, the packaging material comprising:

a core layer of material;

an inside layer of a transparent plastic material having a first and a second side;

a layer of light-reflective material disposed between the core layer and the inside layer, attached to the second side of the inside layer; and the inside layer is sufficiently transparent to transmit incident photoenergy, incident on the first side of the inside layer in amounts greater than 2 Joules/cm$^2$, and the light-reflective layer is sufficiently reflective to reflect the incident photoenergy so that the reflected photoenergy destroys microorganisms and bacteria on the first side of the inside layer not destroyed by the incident photoenergy.

2. The packaging material as set forth in claim 1, wherein the second side of the inside layer is laminated to the light-reflective layer.

3. The packaging material as set forth in claim 2, wherein the light-reflective layer is metal foil.

4. The packaging material as set forth in claim 2, wherein the light-reflective layer is metallized plastic film.

5. The packaging material as set forth in claim 1, wherein the light-reflective layer is vacuum-deposited on the second side of the inside layer.

6. The packaging material as set forth in claim 1, wherein the light-reflective layer includes a glass film and a reflective material.

7. The packaging material as set forth in claim 6, wherein the glass film is vacuum-deposited.

8. The packaging material as set forth in claim 6, wherein the reflective material is vacuum-deposited on the glass film.

9. The packaging material as set forth in claim 1, wherein the core layer includes paper.

10. The packaging material as set forth in claim 1, wherein the core layer includes cardboard.

11. The packaging material as set forth in claim 1, wherein the core layer includes an expanded plastic material.

12. The packaging material as set forth in claim 11, further comprising a layer of gas-tight, vacuum-deposited glass.

13. The packaging material as set forth in claim 1, wherein the core layer includes an expanded plastic material, the inside layer includes transparent plastic film of the same type of plastic as the core layer, and the reflective layer is a vacuum-deposited reflective material deposited on the second side of the inside layer.

14. A method of sterilizing a packaging material of the type including a laminated web structure including at least two layers, one of the layers being an inside layer that contacts contents of a package formed from the packaging material, the method comprising the steps of:

providing a laminate web structure including an inside layer of transparent material, the inside layer including a first and second surface, the inside layer being sufficiently transparent to transmit incident photoenergy, incident on the first surface of the inside layer in amounts greater than 2 Joules/cm$^2$, and a layer of light reflective material substantially adjacent to the second surface of the inside layer the layer of light reflective material being sufficiently reflective to reflect the incident photoenergy; and directing light in rapid pulses onto the inside layer of the web structure, the light pulses being reflected by the reflective material to destroy microorganisms and bacteria on the first surface of the inside layer.

15. The method as set forth in claim 14, comprising the further step of forming the web structure into a tube such that it is disposed concentrically around the light source.

16. The method as set forth in claim 15, comprising the further step of advancing the web structure as it is formed into a tube concentrically around the light source.

17. The method as set forth in claim 15, comprising the further step of uniting longitudinal edges of the web structure as it is formed into a tube.

18. The method as set forth in claim 17, wherein the longitudinal edges are united by fusing together material forming part of the web structure under heat and pressure.

19. The method as set forth in claim 14, wherein the light is incident on the first side of the web structure in an amount between 2 to 10 Joules per cm$^2$.

20. The method as set forth in claim 14, wherein the light source includes one or more flash discharge tubes.

* * * * *